United States Patent [19]

Eber et al.

[11] Patent Number: 4,820,130

[45] Date of Patent: Apr. 11, 1989

[54] TEMPERATURE SENSITIVE SOLENOID VALVE IN A SCROLL COMPRESSOR

[75] Inventors: David H. Eber; Peter A. Kotlarek, both of La Crosse; Ronald W. Okoren, Holmen, all of Wis.

[73] Assignee: American Standard Inc., New York, N.Y.

[21] Appl. No.: 133,576

[22] Filed: Dec. 14, 1987

[51] Int. Cl.[4] ..... F04B 39/08

[52] U.S. Cl. ..... 417/32; 417/292; 417/317; 417/505

[58] Field of Search ..... 417/505, 26, 28, 32, 417/292, 297, 310, 317, 440; 418/55

[56] References Cited

U.S. PATENT DOCUMENTS

| | | | |
|---|---|---|---|
| 4,332,535 | 6/1982 | Terauchi et al. | 418/55 |
| 4,395,203 | 7/1983 | Takada | 417/292 X |
| 4,432,698 | 2/1984 | Shirakuma et al. | 417/27 |
| 4,460,321 | 7/1984 | Terauchi | 418/55 |
| 4,505,651 | 3/1985 | Terauchi et al. | 418/55 X |
| 4,642,034 | 2/1987 | Terauchi | 417/295 |
| 4,655,696 | 4/1987 | Utter | 418/55 |
| 4,666,381 | 5/1987 | Butterworth | 418/55 |

FOREIGN PATENT DOCUMENTS

| | | | |
|---|---|---|---|
| 16292 | 1/1982 | Japan | 418/55 |
| 167893 | 10/1983 | Japan | 418/55 |
| 75792 | 4/1985 | Japan | 418/55 |
| 182371 | 9/1985 | Japan | 417/505 |
| 72889 | 4/1986 | Japan | 417/440 |
| 210279 | 9/1986 | Japan | 417/440 |
| 218792 | 9/1986 | Japan | 417/292 |

*Primary Examiner*—Leonard E. Smith

*Attorney, Agent, or Firm*—William J. Beres; David L. Polsley; Robert J. Harter

[57] ABSTRACT

Inside the hermetic shell of a scroll compressor, a normally closed solenoid valve seats against the back side of a stationary scroll plate to close a discharge opening through the plate. A coil circuit that actuates the valve has an electrical resistance that increases with temperature. The temperature dependent resistance allows the coil circuit to also function as a discharge temperature sensor. Should the discharge gas over-heat, the compressor motor and the valve are de-energized in response to the resistance exceeding a predetermined limit. The closed valve prevents backflow from rapidly reversing the rotational direction of the compressor, which can be extremely noisy and damaging to the compressor. Both the valve and the compressor motor are energized at the same time, regardless of the compressor's direction of rotation. Should the compressor motor be inadvertently wired to operate in reverse, the solenoid valve still opens to prevent destructively low pressure from developing between the scroll plates.

23 Claims, 1 Drawing Sheet

TEMPERATURE SENSITIVE SOLENOID VALVE IN A SCROLL COMPRESSOR

TECHNICAL FIELD

The subject invention generally pertains to a refrigeration system having a scroll compressor, and more specifically pertains to a valve that closes against the back side of a stationary scroll plate to cover a discharge opening.

BACKGROUND OF THE INVENTION

Refrigeration system's having scroll compressor's should be designed to deal with overheating of discharge gas, backflow during shutdown, and reverse rotation due to improperly connecting the motor's electrical leads.

Current systems protect against overheating by employing a temperature sensor attached to a discharge line leading from the compressor's hermetic shell. The compressor motor is de-energized in response to sensing a predetermined temperature limit. This method of protection, however, is inadequate in refrigeration systems which often experience high temperatures during low flow rate conditions. The flow rate can become so low in scroll compressors that the refrigerant at the discharge opening of the stationary scroll plate can exceed the safe operating temperature well before an externally mounted sensor can detect the problem. Nevertheless, such methods of protection are still being used.

Protection against backflow during shutdown is currently accomplished by simply installing a check valve directly over the stationary scroll plate's discharge opening. At shutdown, the check valve prevents high pressure discharge gas from re-entering the scroll plates, which could otherwise rapidly reverse the compressor's direction of rotation and drive the orbiting scroll plate in reverse at extremely high speeds. The rapid reversal jars a scroll compressor's swinglink (drive coupling between the motor and the orbiting scroll plate) and exerts a severe bending moment on the compressor's "Oldham" coupling (anti-rotation coupling). A swing link (Item 13, FIG. 1) and an Oldham coupling (Item 15, FIG. 1), as well as other details of a scroll compressor, are disclosed in U.S. Pat. Nos. 4,655,696 and 4,666,381 which are specifically incorporated by reference herein.

To be effective, the check valve must be positioned inside the compressor's shell, directly over the scroll plate's discharge opening to minimize the volume between the valve and the opening. However, the pressure of the small volume at the discharge opening fluctuates due to the normal operating characteristics of a scroll compressor. This causes the check valve to flutter, resulting in unnecessary noise and valve wear. Attempts have been made to locate the valve on a discharge line outside the shell. Such a location, however, leaves enough pressurized refrigerant between the valve and the discharge opening to briefly drive the compressor in reverse at thousands of RPM upon de-energizing the compressor motor.

The same check valve, used for protection against backflow, presents another problem should the compressor motor ever be improperly wired to rotate in reverse. This is a common problem with 3-phase motors whose rotational direction is simply reversed by switching two of its three motor leads. In reverse rotation, the check valve prevents gas from passing through the compressor which causes an extremely low pressure to develop between the scroll plates. The low pressure forces the scroll plates together with damages the tips of their scroll wraps.

Although it may be possible to address each of the above problems individually, it is an object of the invention to solve all of the above problems by employing a single solenoid valve mounted inside a hermetic shell of a scroll compressor.

Another object of the invention is to provide a method of sensing the temperature of the refrigerant just as its leaving a discharge opening through a stationary scroll plate.

Another object of the invention is to use the coil of a solenoid valve to sense the temperature of discharge refrigerant inside the hermetic shell of a scroll compressor.

Yet another object is to avoid the higher flow resistance associated with many conventional solenoid valves by using the back side of a stationary scroll plate as a valve seat.

A further object is to penetrate a scroll compressor's hermetic shell with only two electrically feedthroughes that are connected to actuate a solenoid valve disposed inside the shell and connected to a means for sensing the temperature of the refrigerant inside the shell.

A still further object is to avoid valve flutter by providing a scroll compressor with a solenoid valve disposed inside the compressor's hermetic shell, and magnetically holding the valve fully open whenever the compressor's motor is energized.

Another object of the invention is to allow refrigerant, whenever the compressor motor is energized, to flow in either direction through a discharge opening in the compressor's stationary scroll plate, regardless of the compressor's rotational direction, and when the compressor motor is de-energized, allow refrigerant to flow in only one direction.

These and other objects of the invention will be apparent from the attached drawings and the description of the preferred embodiment which follows hereinbelow.

SUMMARY OF THE INVENTION

The subject invention is a scroll compressor having a solenoid valve disposed inside the compressor's hermetic shell. The valve has a valve plug that seats against the back side of a stationary scroll plate to close a discharge opening through the plate when the compressor's motor is de-energized. A temperature sensitive coil circuit is energized to magnetically lift the plug and uncover the discharge opening whenever the motor is energized, regardless of its rotational direction. The motor de-energizes and the valve closes in response to the coil circuit sensing that refrigerant being discharge through the compressor shell has reached an upper limit.

DESCRIPTION OF THE PREFERRED EMBODIMENT

Figure 1:
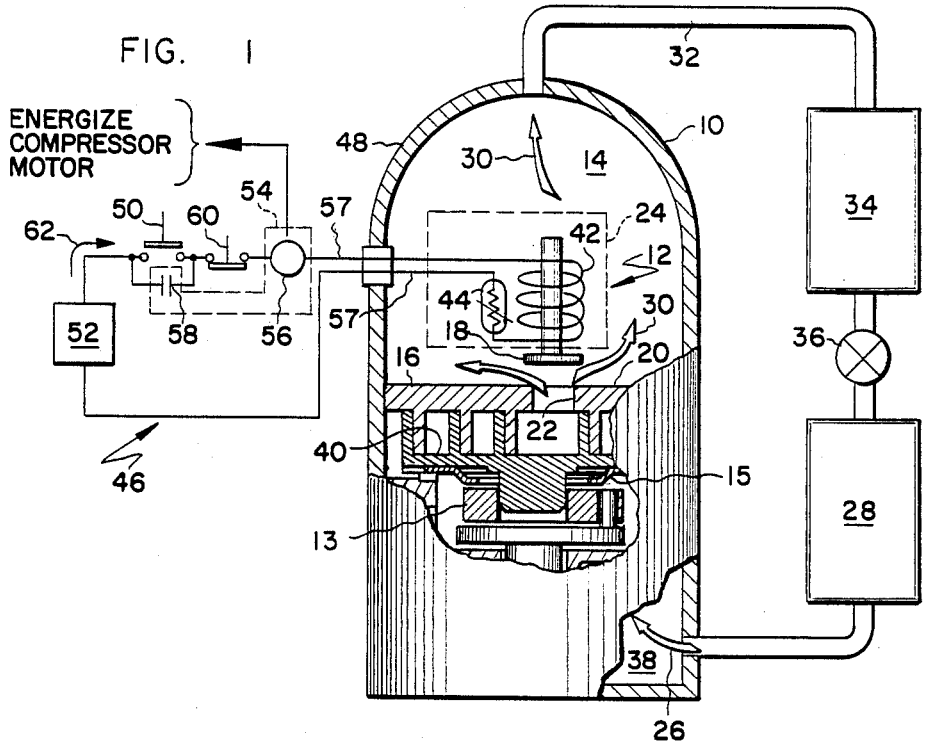
FIG. 1 illustrates the preferred embodiment of the invention.

The refrigeration system shown in FIG. 1 includes a scroll compressor 10 have an internal valve 12. Although valve 12 represents any electrically actuated valve, it will be referred to hereinbelow as a solenoid valve. Solenoid valve 12 is disposed in a high pressure discharge chamber 14 just above the compressor's stationary scroll plate 16. In the preferred embodiment, valve 12 includes a valve plug 18 that is positioned to seat against a back side 20 of scroll plate 16 to cover a discharge opening 22. Valve 12 is actuated by a coil circuit 24 that, when energized, magnetically lifts plug 18 to uncover opening 22. When de-energized, plug 18 falls against back side 20 to close opening 22. Valve 12 is shown open in FIG. 1, and a similar valve 12' is shown closed in FIG. 2.

Solenoid valve 12 and the compressor's motor are both energized and de-energized together so that valve 12 opens to uncover opening 22 whenever compressor 10 is operating. During normal operation, compressor 10 draws in low pressure refrigerant 26 from an evaporator 28 and discharges high pressure refrigerant 30 through opening 22, past valve 12, through discharge line 32, and into a condense 4 34. The high pressure refrigerant 30 leaves condenser 34 and returns to evaporator 28 by way of an expansion device 36.

The compressor motor and solenoid valve 12 are de-energized to shut down the system. At the instant the compressor motor is de-energized, the high pressure refrigerant 30 in chamber 14 attempts to rush in reverse flow through the compressor and back to the compressor's low pressure suction side 38 that is connected to evaporator 28. However, since valve 12 is also de-energized at shutdown, valve 12 closes to prevent the backflow problem.

If the compressor's motor leads are every improperly connected to drive the compressor in reverse rotation, valve 12 is still controlled to open when the motor is energized. With valve 12 held open, a reverse flow of refrigerant under the impetus of the reverse rotating compressor, is free to pass through the compressor. Valve 12 being open, prevents extremely low pressures from developing between scroll plates 16 and 40, which would otherwise occur if opening 22 were closed.

The valve's coil circuit 24 has an electrical impedance that increases with temperature. In the preferred embodiment of the invention, coil circuit 24 comprises a solenoid coil 42 connected in series with a thermistor 44 having a positive temperature coefficient (having an electrical resistance that increases with temperature). Thermistor 44 represents any device whose resistance changes with temperature, such as a normally closed temperature responsive switch that opens to break continuity at a predetermined temperature limit. Coil circuit 42 is inside chamber 14 to function as part of a protection scheme that de-energizes both the compressor motor and valve 12 in response to the high pressure refrigerant 30 exceeding 300° F. The 300° F. value is a predetermined upper temperature limit that may be changed to suit a specific refrigeration system.

The protection scheme further includes a control circuit 46 located outside the compressor's hermetic shell 48. Upon closing a momentary switch 50, a 110 volt AC power supply 52 energizes a relay 54 whose coil 56 is connected in series with coil circuit 24 by way of two feedthroughes 57. Energizing relay 54 closes its primary contacts (not shown) and its auxilliary contacts 58. The primary contacts energize the compressor's motor, while auxilliary contacts 58 maintain continuity after switch 50 is released. Circuit 46 also includes a normally closed switch 60 that breaks the continuity to de-energize the motor and close valve 12 simultaneously.

Under certain adverse operating conditions, the temperature of discharge refrigerant 30 may rise to unsafe levels. A rising temperature increases the impedance of coil circuit 24 due to the thermistor's increasing resistance. When the refrigerant temperature exceeds the predetermined upper limit, the increased impedance of coil circuit 24 substantially reduces the current 62 to coil 56, causing relay 54 to drop out which de-energizes the compressor motor and coil circuit 25. In effect, relay 54 serves as a means for detecting a change in impedance of coil circuit 25, and also serves to de-energize the compressor motor and solenoid valve 12 in response to the refrigerant temperature exceeding the predetermined upper limit.

It should be appreciated by those skilled in the art that sensing a change in impedance is a relatively simple matter that can be accomplished in any number of ways. In addition, thermistor 44 could have a negative temperature coefficient (resistance decreases with temperature), and a properly designed control circuit could de-energize both the compressor motor and the solenoid valve in response to the impedance dropping to a predetermined lower limit. It should also be noted that although circuit 46 includes 110 VAC power supply 52, a 24 VAC supply could be used instead, provided the control circuit and the coil circuit and modified accordingly.

Figure 2:
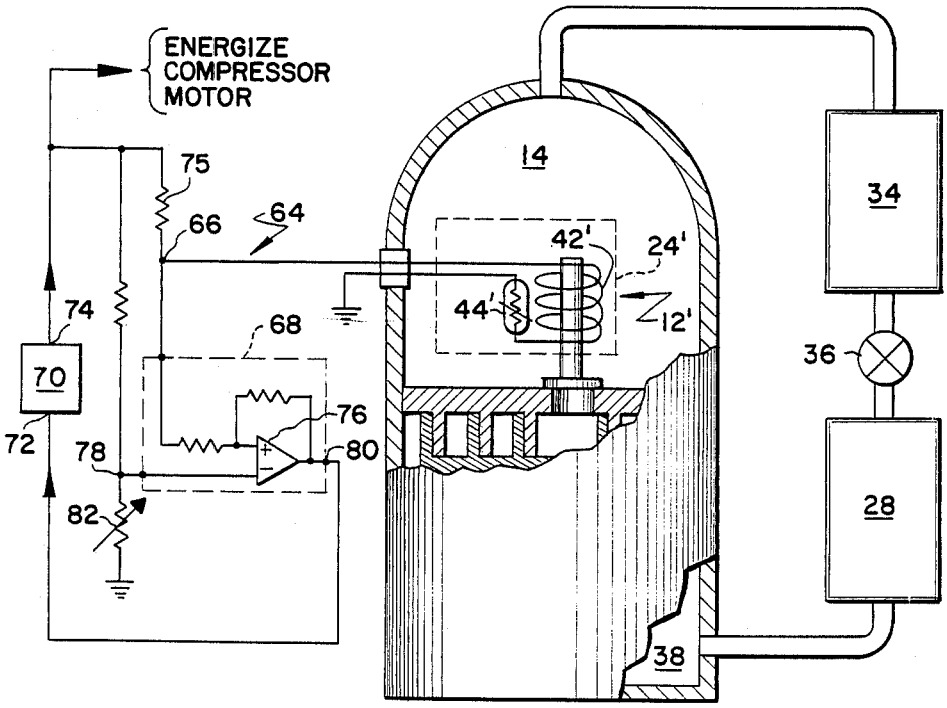
FIG. 2 illustrates another embodiment of the invention.

The invention can also be modified to operate with a DC control circuit 64 as shown in FIG. 2. A coil circuit 24' is designated to open valve 12' upon receiving a 5 volt DC supply from control circuit 64 at point 66. Control circuit 64 includes a comparator 68 and a logic circuit 70 having an input 62 and an output 74. Logic circuit 70 provides 9 volts DC at output 74 to open solenoid valve 12' through resistor 75. Output 74 also energizes the compressor motor by means of a relay (not shown).

Comparator 68 provides a means for detecting a change in resistance of coil circuit 24'. It does this by employing an operational amplifier (op amp) 76 that compares the voltage applied to coil circuit 24' to a reference voltage at point 78. During normal operating conditions, the coil circuit voltage at point 66 is less than the reference voltage at point 78 which results in no overheat signal, i.e., the output of op amp 76 at point 80 is in a low binary state such as zero volts. When the temperature of the refrigerant exceeds the predetermined safe temperature, the resistance of thermistor 44' increases dramatically, causing the voltage at point 66 to exceed the reference voltage at point 78. This causes the output of op amp 76 to become a binary high (e.g., 9 volts DC) which is supplied as the overheat signal to input 72. Upon receiving the overheat signal, logic circuit 70 drops its 9 volt DC output to zero at output 74 which stops the compressor and closes valve 12' for a predetermined period or until the refrigeration system is manually reset.

The system shown in FIG. 2 can be further modified by eliminating thermistor 44' and relaying soley on the inherent temperature coefficient of coil 42' itself. It is well known that copper, as well as other readily available electrical conductors such as iron, nickel, aluminum, and associated alloys have an electrical resistance that increases with its temperature. However, if the specific conductor used in coil 42' has a much lower temperature coefficient than a conventional thermistor, the control circuit must have a greater sensitivity to the coil circuit's less noticeable resistance changes. A more sensitive circuit design requires closer component tolerances and/or means for compensating for components of varying tolerances. For example, a variable potentiometer 82 would be one way to compensate for solenoid coils having different resistance characteristics. Potentiometer 82 can also be used to vary the upper temperature limit at which the valve closes.

Although the invention is described with respect to a preferred embodiment, modifications thereto will apparent to those skilled in the art. Therefore, the scope of the invention is to be determined by reference to the claims which follow.

We claim:

1. A refrigeration apparatus comprising:

(a) a condenser;

(b) an evaporator;

(c) a scroll compressor disposed inside a hermetic shell and connected to deliver refrigerant from said evaporator to said condenser, said compressor having a stationary scroll plate with a discharge opening therethrough; and (d) a solenoid valve disposed inside said shell adjacent to said discharge opening to pass substantially all of said refrigerant being delivered from said evaporator to said condenser, said valve being adapted to close said discharge opening to substantially block any refrigerant from being delivered from said evaporator to said condenser.

2. The refrigeration apparatus as recited in claim 1, further comprising a swinglink disposed inside said shell.

3. The refrigeration apparatus as recited in claim 1, further comprising an anti-rotation coupling disposed said shell.

4. The refrigeration apparatus as recited in claim 1, wherein said valve plug covers said discharge opening when a motor driving said compressor is de-energized, and said solenoid valve is actuated to uncover said opening when said motor is energized.

5. The refrigeration apparatus as recited in claim 1, wherein said valve includes a valve plug that seats against a back side of said scroll plate to cover said discharge opening.

6. The refrigeration apparatus as recited in claim 1, wherein said solenoid valve is actuated by a coil circuit having an impedance that changes with its temperature.

7. The refrigeration apparatus as recited in claim 6, wherein said impedance increases with temperature.

8. The refrigeration apparatus as recited in claim 6, wherein said coil circuit includes a temperature responsive switch.

9. The refrigeration apparatus as recited in claim 6, wherein said coil circuit includes a thermistor.

10. The refrigeration apparatus as recited in claim 9, wherein said thermistor has a positive temperature coefficient, whereby its resistance increases with temperature.

11. The refrigeration apparatus as recited in claim 6, further comprising a means for detecting a change in impedance.

12. The refrigeration apparatus as recited in claim 11, wherein said means for detecting a change in impedance includes a relay having a coil connected in series with said coil circuit, said relay being located outside of said shell and connected to de-energize a compressor motor disposed inside said shell.

13. The refrigeration apparatus aa recited in claim 11, further comprising a controller that de-energizes said solenoid valve and de-energizes a compressor motor in response to said impedance changing to a predetermined limit.

14. The refrigeration apparatus as recited in claim 11, wherein said means for detecting includes a comparator.

15. The refrigeration apparatus as recited in claim 14, wherein said comparator includes an operational amplifier.

16. A refrigeration apparatus comprising:

(a) a condenser;

(b) an evaporator;

(c) a scroll compressor disposed inside a hermetic shell and connected to draw a refrigerant from said evaporator and discharge said refrigerant to said condenser;

(d) a solenoid valve disposed inside said shell and being connected to pass substantially all of said refrigerant being discharged to said condenser, said valve being actuated by a coil circuit that is disposed inside said shell in heat transfer relationship with said refrigerant being discharged to said condenser, said coil circuit having an electrical impedance that changes with the temperature of said coil circuit, whereby said impedance changes with the temperature of said refrigerant being discharged to said condenser; and (e) a control circuit having means for detecting a change in impedance of said coil circuit, said control circuit being electrically connected to control said coil circuit and to control a motor driving said compressor, such that said motor is de-energized and said solenoid valve closes when a change in said impedance indicates that the temperature of said refrigerant being discharged to said condenser reaches a predetermined upper temperature limit.

17. The refrigeration apparatus as recited in claim 16, wherein said coil circuit includes a thermistor having a positive temperature coefficient, whereby the electrical resistance of said thermistor increases with temperature.

18. The refrigeration apparatus as recited in claim 16, wherein said coil circuit includes a temperature responsive switch.

19. The refrigeration apparatus as recited in claim 16, wherein said means for detecting a change in impedance includes a relay having a coil connected in series with said coil circuit, said relay being located outside of said shell and connected to de-energize said motor.

20. The refrigeration apparatus as recited in claim 16, further comprising a swinglink and an anti-rotation coupling disposed inside said shell.

21. A refrigeration apparatus comprising:

(a) a condenser;

(b) an evaporator;

(c) a scroll compressor disposed inside a hermetic shell and connected to draw a refrigerant from said evaporator and discharge said refrigerant to said condenser, said compressor including a stationary scroll plate having a discharge opening through which substantially all of said refrigerant being discharged to said condenser passes;

(d) a solenoid valve disposed inside said shell adjacent to said discharge opening, said valve having a valve plug that is adapted to seat against a back side of said scroll plate to cover said discharge opening, said valve being actuated by a coil circuit that is disposed inside said shell and includes a solenoid coil connected in series with a thermistor that is in heat transfer relationship with said refrigerant being discharged to said condenser, said thermistor having an electrical resistance that increases with temperature, whereby said electrical resistance increases to increase the electrical impedance of said coil circuit in response to an increase in temperature of said refrigerant being discharged to said condenser;

(e) means for detecting a change in impedance of said coil circuit comprising a relay having a coil connected in series with said coil circuit so that said relay is de-energized when the electrical impedance of said coil circuit changes to a higher impedance brought about by the temperature of said refrigerant being discharged reaching a predetermined upper temperature limit; and (f) electrical contacts associated with said relay and connected to de-energize a motor driving said compressor and connected to de-energize said coil circuit in response to said relay being de-energized.

22. The refrigeration apparatus as recited in claim 21, further comprising a swinglink disposed inside said shell.

23. The refrigeration apparatus as recited in claim 21, further comprising an anti-rotation coupling disposed inside said shell.

* * * * *

UNITED STATES PATENT AND TRADEMARK OFFICE

CERTIFICATE OF CORRECTION

PATENT NO. : 4,820,130

DATED : April 11, 1989

INVENTOR(S) : David H. Eber, Peter A. Kotlarek and Ronald W. Okoren

It is certified that error appears in the above-identified patent and that said Letters Patent is hereby corrected as shown below:

Column 2, line 5, "with" should be --which--.

Column 2, line 25, "electrically" should be --electrical--.

Column 2, line 59, "discharge" should be --discharged--.

Column 3, line 26, "condense 4" should be --condenser--.

Column 3, line 38, "every" should be --ever--.

Column 4, line 16, "25" should be --24--.

Column 4, line 18, "25" should be --24--.

Column 4, line 40, "62" should be --72--.

Signed and Sealed this

Twenty-eighth Day of November 1989

*Attest:*

JEFFREY M. SAMUELS

*Attesting Officer*

*Acting Commissioner of Patents and Trademarks*